US005556696A

United States Patent [19]

Pinkus

[11] Patent Number: 5,556,696

[45] Date of Patent: Sep. 17, 1996

[54] STIFFENING MATERIAL FOR HEADWEAR AND THE LIKE

[76] Inventor: Fred J. Pinkus, 1254 Knox Dr., Yardley, Pa. 19067-4424

[21] Appl. No.: 310,874

[22] Filed: Sep. 23, 1994

[51] Int. Cl.[6] ..... D03D 3/00

[52] U.S. Cl. ..... 428/229; 2/195.1; 2/209.12; 139/420 A; 428/257; 428/258; 428/259; 428/343; 428/354

[58] Field of Search ..... 428/229, 257, 428/258, 259, 343, 354; 2/171, 171.1, 171.7, 209.12, 195.1; 139/420 A, 426

[56] References Cited

U.S. PATENT DOCUMENTS

| | | | |
|---|---|---|---|
| D. 170,398 | 9/1953 | Briers | D3/13 |
| 1,749,634 | 3/1930 | Frank . | |
| 2,004,913 | 6/1935 | Klein | 2/195 |
| 2,146,664 | 2/1939 | Wolff | 139/383 |
| 3,085,252 | 4/1963 | Smith | 2/195 |
| 3,142,109 | 7/1964 | Stoll et al. | 28/75 |
| 3,991,246 | 11/1976 | Schneider | 428/195 |
| 4,234,022 | 11/1980 | Okamoto et al. | 139/420 R |
| 4,435,442 | 6/1984 | Hefele | 427/14.1 |
| 4,670,326 | 6/1987 | Heiman | 428/225 |
| 4,724,183 | 2/1988 | Heiman | 428/225 |
| 4,880,691 | 11/1989 | Sawyer et al. | 428/229 |
| 4,989,270 | 2/1991 | Boughten | 2/171.7 |
| 5,046,196 | 9/1991 | Sullivan | 2/181.4 |
| 5,093,163 | 3/1992 | Krummheuer et al. | 428/35.1 |
| 5,100,713 | 3/1992 | Homma et al. | 428/102 |
| 5,181,277 | 1/1993 | Sherman | 2/195 |
| 5,282,278 | 2/1994 | Miner | 2/195.1 |
| 5,304,414 | 4/1994 | Bainbridge et al. | 428/229 |

*Primary Examiner*—James J. Bell

*Attorney, Agent, or Firm*—Woodcock Washburn Kurtz Mackiewicz & Norris

[57] ABSTRACT

A lining fabric is disclosed that preferably uses a fine spun yarn, most preferably a 50/50 blend of cotton and viscose rayon that has a cross-sectional diameter of 30/1, in which the warp fibers are woven in a dense pattern, most preferably to an end count of about 72 ends per inch. Thus, as compared to the prior art there are finer warp yarns and an increased number of warp yarns. Preferably, monofilament filler yarn is woven into the warp yarns. The thinner material provides better heat transfer for blocking and finishing operations. In addition, the fabric provides an improved backing surface that improves the ability of the outer shell fabric to accept embroidery, and also provides the additional benefit of providing a finer more "linen-like" appearance to the inside of the cap.

19 Claims, 1 Drawing Sheet

STIFFENING MATERIAL FOR HEADWEAR AND THE LIKE

The present invention directed to textiles, and in particular textiles used as a stiffener and in headwear such as baseball caps.

BACKGROUND OF THE INVENTION

Various prior patents have disclosed specialized fabrics for use as stiffening or backing components in a multi-layer fabric structure. For example, Frank U.S. Pat. No. 1,749,634 discloses a plain weave necktie lining fabric. Stoll et al. U.S. Pat. No. 3,142,109 is directed to scrim fabrics and discloses a fabric that has a plurality of warp yarns of cotton or rayon, and the weft yarns are comprised of a synthetic thermoplastic fiber material. Schneider U.S. Pat. No. 3,991,246 discloses a web of woven fabric for the production of reinforcing inlays in which the warp threads have differing density in certain areas of the web for purposes of increasing structural rigidity. Homma et al. U.S. Pat. No. 5,100,713 discloses a reinforcing fabric that has a reinforcing filament yarn arranged to form a high density portion of the warps with wefts of reinforcing yarn extending obliquely into the warps. The fabric is a highly specialized fabric intended to be laminated into composite materials used in aerospace applications. Bainbridge et al. U.S. Pat. No. 5,304,414 discloses a non-laminated woven sailcloth that uses a reinforcing fiber such as Kevlar™ in either the warp direction, the weft direction, or both directions.

Apart from fabrics specifically intended for stiffening or backing in a multi-layer constructions, it is also known in the prior art that certain weaves combining various types of threads with various weave patterns can be chosen to produce specific properties, e.g., strength. Thus, Wolff U.S. Pat. No. 2,146,664 discloses a fabric wherein the weft threads exhibit a greater number of piles than the warp threads, with the resultant cloth not differing in appearance but being considerably stronger. Okamoto, et al. U.S. Pat. No. 4,234,022 discloses a fabric having both extra fine and relatively heavier weft yarns, and a warp of relatively heavier denier. Heiman U.S. Pat. No. 4,670,326 discloses a woven plain weave sheeting material that uses warps made of a blend of synthetic and natural material and wefts made of a natural material. Heiman U.S. Pat. No. 4,724,183 is a related patent that discloses a woven sheeting material that has 75 warps per square inch and 68 wefts per square inch. Krummheuer et al. U.S. Pat. No. 5,093,163 discloses fabric that has a very dense structure, with a thread count of 23 to 28 per centimeter in the warp and weft.

Various patents disclosing caps have also been granted. For example, Klein U.S. Pat. No. 2,004,913 discloses a cap that has an open woven structure to provide a ventilated inner section of the cap. Briers U.S. Pat. No. De. 170,398 discloses the ornamental appearance of the exterior of a duck-billed cap. Smith U.S. Pat. No. 3,085,252 discloses a baseball-style cap that has its front piece permanently creased by stitching so that it is vertically upstanding. Boughten U.S. Pat. No. 4,989,270 discloses a cap that has a movable divider formed of a flexible sheet of material. The movable divider provides an inner liner for the cap that can be moved to either cover the entire inner surface of the cap or only the front portion. Sullivan U.S. Pat. No. 5,046,196 discloses a cap that has a removable and adjustable inner liner. In one embodiment, in addition to a removable headband, a removable liner that covers part of the interior surface of the cap is also disclosed. Sherman U.S. Pat. No. 5,181,277 discloses a reversible hat with a stiffening layer that maintains the shape of the hat when reversed from one side to another.

The foregoing patents relate to both the utility of the structure, as well as the ornamental appearance of the cap. In the headwear field, these two concepts are often intertwined since the aesthetic features of the cap are often dictated by the construction, or, conversely, the desired aesthetic appearance is achieved using a particular construction technique or a certain material or combination of materials. A unique aspect of headwear in general and baseball style caps in particular is that when the cap is not being worn, the inner lining is exposed. This is in contrast to the inner lining fabrics used in garments such as suit jackets, neckties, and the like. Thus, the lining of a cap represents another area where aesthetics and the structure of the object go hand in hand.

The present state of the art is to use a lining material comprised of woven fabric of warp and weft yarns that may or may not be fused by heat to the outer shell material of the cap. This lining material provides both stiffening to help retain the shape of the cap, and provides a backing that permits embroidery to be applied to the front of the cap. An example of this type of headwear interlining fabric is manufactured and sold by Crown Textile Company of Taladega, Ala. (U.S.A.), as Style 2323, which is a monofilament polyester/rayon fabric that has a "pick count" of 23 and is sold in three stiffness grades: medium, firm and very firm. As known in the art, pick count is one way of characterizing a fabric, another is ends per inch. In the case of the aforementioned prior art fabric, the warp ends per inch is 58.

However, this and other fabrics presently in use in the headwear industry are inadequate for a number of reasons. First, the appearance of the interior of the cap is less than perfect, the mesh structure of the backing fabric being such that the colors of the cap material "bleed through" and are visible when the cap is not being worn. Similarly, any irregularities, slubs or other imperfections in the lining material are also readily apparent due to the contrast between the lining material and the material of the cap. Moreover, the presently available lining materials are such that their stiffness and irregular construction actually tends to interfere with the application of embroidery, and in particular interferes with the application of very fine resolution embroidery. For example, very small letters or small intricate designs such as the copyright (©) symbol or registered trademark (®) symbol—one of which is often required to be applied along with a logo that is on the cap.

Thus, it is an object of the present invention to provide a fabric that facilitates the embroidery process rather than causing interference. Additionally it is another object of the present invention to provide improved aesthetics to the inner surface of a cap. It is a further object of the present invention to disclose a fabric that provides shape retention for a cap to a degree selective by varying degrees of finish additive. Finally, it is an additional objective of the present invention to provide a fabric particularized to headwear that will provide quality, appearance and market interest.

SUMMARY OF THE INVENTION

The present invention provides a fabric having a thin cross-sectional dimension to provide a construction which creates an opportunity for easier needle penetration during embroidery, with less friction, distortion and interference to decorative embroidery thread. Additionally, the fabric of the present invention provides improved aesthetics within the cap due to the increased cover factor or number of warp ends per inch. This provides closer construction, which offers a more linen-like or closed look, rather than the open weave look of the prior art.

The structure of the fabric of the present invention also provides reduced slippage potential of monofilament yarns due to the increased warp yarn count per inch, which functions as an improved retention mechanism which grasps and holds monofilament yarns in position both during fabric processing as well as during the cap manufacturing process. This feature further contributes to the cap quality and aesthetic appearance by retaining the ordered "linen-like" appearance of the fabric after the final cap is manufactured.

The fabric of the present invention also provides excellent shape retention which can be varied by selecting the finish additive applied to the fabric to range from soft to extra firm. The thinner warp matrix also provides improved thermal transport qualities during the fusing of a cap as well as blocking. In certain embodiments, the backing material will not be thermally fused, but in those embodiments where thermal fusing is employed it is crucially important to facilitate thermal transfer while the hat is being blocked. Because of the benefits provided by the present invention, less effort in the fusing process is required, and thus the conditions of time, temperature and pressure required to achieve a satisfactory bond are optimized.

In addition, regardless of whether or not heat fusing is used, the blocking or final shape pressing process used in hat making is eased using the present invention. The blocking process removes all the latent distortions developed throughout the cap manufacturing process, the object of blocking is therefore to place the cap on top of a form that is steam heated and the form reshapes the cap into the shape of the wearer's head. The thinner construction of the present invention allows for a rapid penetration of steam, and a more pliable front piece of the cap, thereby aiding the reshaping and blocking process.

The present invention thus provides fabric that is particularly well-suited to the manufacture of headwear, and which provides improved quality for cap construction, appearance and market interest. The present invention also beneficially reduces the handling and production time requirement as compared to traditional prior art stiffeners. Thus, both a better cap and a less expensive cap can be manufactured using the present invention.

DETAILED DESCRIPTION OF THE PREFERRED EMBODIMENTS

Figure 1:
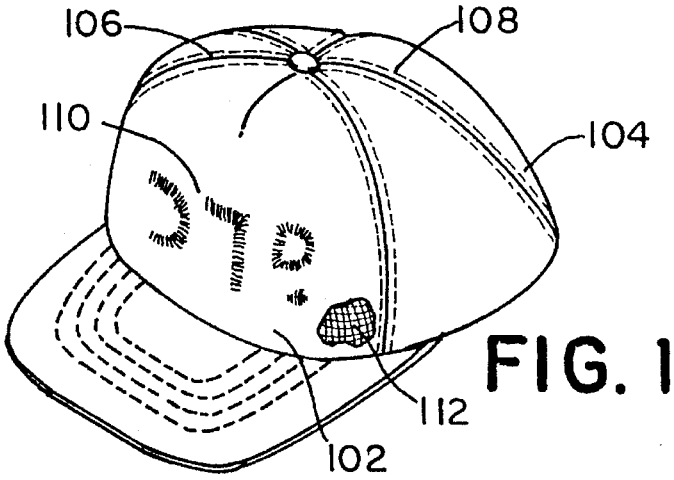
FIG. 1 is a perspective view of a baseball-style cap, partially cut away to illustrate its construction.
Figure 2:
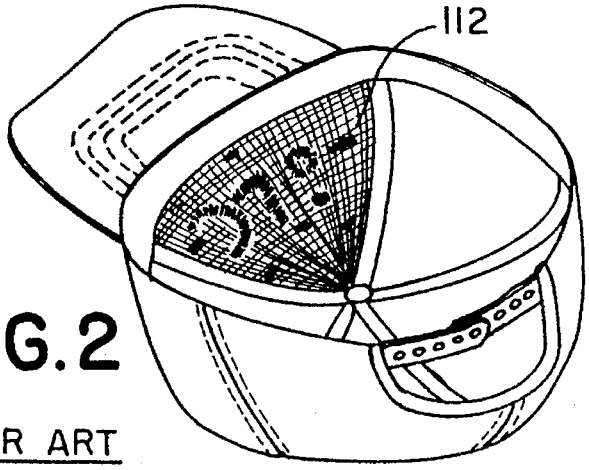
FIG. 2 PRIOR ART
FIG. 2 is a perspective view of the cap similar to FIG. 1 made in accordance with the prior art and showing the interior of the cap.
Figure 3:
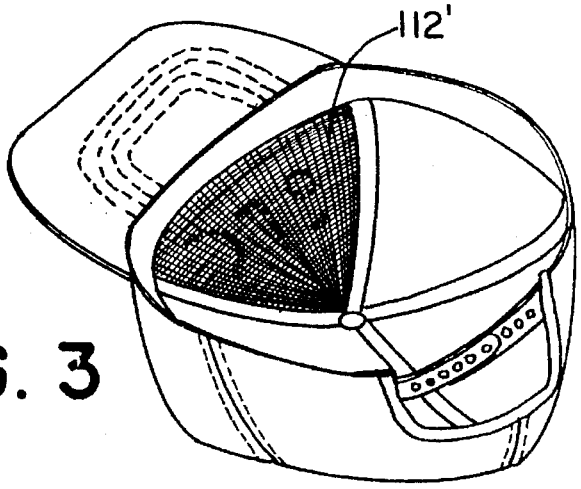
FIG. 3 is a perspective view of the cap shown in FIG. 2 made in accordance with the present invention and showing the interior of the cap.

Referring now to FIGS. 1–3 certain advantages and features of the present invention are illustrated. FIG. 1 illustrates a typical baseball-style cap 100. The cap 100 is comprised of an outer shell fabric 102 that is held together by cap stitches 104. The front portion of the cap typically includes a peak 106 created by a peak stitch 108. Many caps are decorated with a embroidery 110 on the front portion of the cap, as also illustrated in FIG. 1. As seen in the cut away section of FIG. 1, the shell fabric 102 overlies a lining and stiffening fabric 112, to which the present invention is directed.

The interior of the cap 100 illustrated in FIG. 1 is shown in FIG. 2. In caps made in accordance with the prior art, as illustrated, the embroidery 110 is visible through the stiffening fabric 112, as is the color of the shell fabric 102, particularly if the color of the shell fabric or embroidery contrast with the color of the stiffening fabric 112, which is typically white or off-white.

Although, as explained in further detail, the present invention offers a number of advantages involving the construction of headwear such as the cap 100 illustrated, the aesthetic improvement provided by the fabric of the present invention is visible in FIG. 3. As shown, the stiffening fabric 112' provides a more solid and even appearance to the inside of the cap. Although the embroidery 110 may be faintly visible, the amount of "bleed through" is even and consistent, and much more pleasing to the eye than caps made in accordance with the prior art. In this way, the present invention improves the ornamental aspects of the cap 100 separate and apart from the functional improvements discussed below.

In the fabric of the present invention, a large number of very fine warp yarns are used that increase the opacity of the fabric while reducing its thickness. The resulting fabric thus covers the reverse side of the cap front while providing a thinner fabric that is a better backing for embroidery than the fabric of the prior art. Specifically, the present invention is most preferably comprised of a 30/1 warp yarn woven at 72 ends per inch, in contrast to the prior art fabric that uses warp yarn having a cross-section between 10/1 to 15/1 at 24–58 ends per inch. Although a 30/1 yarn at 72 ends per inch is a most preferred embodiment, it will be appreciated that both finer yarns and denser weaves are useful in certain embodiments. Moreover, both the size of the yarn can be increased and the ends per inch decreased to approach the weave of the prior art and still result in a useful embodiment of the present invention. Thus, fabrics having an ends per inch count between 58 and 72 are also useful. Additionally, in preferred embodiments, the warp yarn is a fine spun 50/50 blend of polyester and viscose rayon spun by the short cotton staple spinning system familiar to those of skill in the art. The use of a fine spun warp yarn in conjunction with a monofilament filling yarn has an additional advantage in that the finer and denser warp yarns retain the monofilament yarns in position within the fabric matrix to a greater degree than found in prior art fabrics.

The filling of the fabric of the present invention is preferably a standard monofilament, however, the benefits of the present invention can also be achieved using a spun yarn in the filling direction as well. As known in the art, the use of a monofilament yarn provides a mechanism that creates a resilience or "spring" in the fabric that provides a measure of shape retention when the fabric is formed into a three dimensional structure such as a cap. The shape retention can be varied from soft to extra firm depending upon the finish additive used to shape the cap. Examples of such finishing additives are acrylic binder systems.

Thus, the specific embodiment referred to above is an illustrative embodiment and numerous variations in warp and filler yarn size, weave pattern and density and other factors are also useful and form a part of the present invention.

As noted above, the fabric of the present invention provides advantages in terms of embroidery because the thinner fabric is not strong enough to interfere with the embroidery needle, and the finer threads permit easier penetration that results in less needle friction during the embroidery process. This is an important improvement because the heat generated by needle friction is a function of speed, and therefore reducing the friction allows for increased speed and thus enhanced production rates. Thus, the fabric of the present invention enhances the embroidery process, rather than acting as a detriment.

The thinness of the fabric of the present invention, along with the shape retention properties described above, are also an important factor in improvements gained in the production of the caps themselves, apart from improvements in the embroidery process. Thus, the fabric of the present invention offers advantages even in caps where no embroidery is applied. The thinner warp matrix described above provides improved thermal transport during steps such as fusing and blocking. As known in the art, fusing involves using thermosetting adhesives to bond the stiffening fabric to the shell fabric, while blocking involves using a heated form to shape the cap into its final form. These are two crucially important steps in the cap making process that can be made more efficient through the benefits of the fabric of the preset invention.

In particular, the fusing process is dependent upon time, temperature and forming pressure and the present invention permits both time and temperature to be reduced. The reduction in temperature is beneficial in several ways: the cost of energy is reduced and the likelihood that the reduced temperature will distort or scorch the outer fabric is reduced.

Similarly, the blocking process, which is designed to remove all the latent distortions created by the manufacturing process, involves placing the cap on a heated metal "head" shaping form using steam to reshape the cap. The efficiency of this process is enhanced by the improved properties that allow quicker penetration of the steam, and pliable nature of the fabric of the present invention.

Thus, the fabric of the present invention provides a stiffening function while enhancing the productivity of the cap manufacturing and finishing processes as well as increasing the ability of the finished cap to accept embroidery.

Finally, a separate advantage of the fabric of the present invention described above with reference to FIGS. 1–3 is that improved aesthetics within the cap are provided. As mentioned above, the finer warp yarns of the fabric of the present invention tend to hold the filler yarn, particularly monofilament yarn in place to a greater degree than found in prior art fabrics. The slippage found in prior art fabrics contributed to the poor aesthetic quality of the finished cap interior. The fabric permitted more of the back side of the front of the cap to show through, and this appearance emphasized the irregularity of the stiffener fabric. The increased number of warp yarns provide an increased cover factor that provides a solid, finished appearance to the interior of the cap.

Although certain embodiments of the present invention have been described herein with particularity, these embodiments have been provided for purposes of illustrating the invention and are not meant to provide limitations. Upon review of the foregoing specification, those of skill in the art will immediately realize numerous modifications, adaptations and variations upon the inventions disclosed herein without departing from the spirit of that which is disclosed. Accordingly, reference should be had to the appended claims in order to ascertain the true scope of the present invention.

What is claimed is:

1. A woven fabric comprising a warp yarn having a cross-section diameter of less than 15/1 and is woven at more than 58 ends per inch and a filler yarn.

2. The fabric of claim 1 wherein the cross-section diameter is 30/1 or less and the fabric is woven to at least 72 ends per inch.

3. The fabric of claim 1 wherein the filler yarn comprises a monofilament yarn.

4. The fabric of claim 1 wherein the warp yarn is a fine spun 50/50 blend of polyester and viscose rayon.

5. The fabric of claim 1 wherein the warp yarn is spun by the short cotton staple spinning system.

6. The fabric of claim 1 further comprising a thermosetting adhesive.

7. The fabric of claim 1 further comprising an additive for selectively affecting the resilience of the fabric.

8. A headwear stiffener woven fabric comprising very fine warp yarns having a cross-section diameter of less than 15/1 that increase the opacity of the fabric while reducing its thickness, and a filler yarn.

9. A cap comprising an outer shell material and a woven-fabric stiffener comprised of very fine warp yarns having a cross-section diameter of less than 15/1 that increase the opacity of the fabric while reducing its thickness; and a filler yarn.

10. The fabric of claim 9 wherein the cross-section diameter is 30/1 or less and the fabric is woven to at least 72 ends per inch.

11. The fabric of claim 9 wherein the filler yarn comprises a monofilament yarn.

12. The fabric of claim 9 wherein the warp yarn is a fine spun 50/50 blend of polyester and viscose rayon.

13. The fabric of claim 9 wherein the warp yarn is spun by the short cotton staple spinning system.

14. The fabric of claim 9 further comprising a thermosetting adhesive.

15. The fabric of claim 9 further comprising an additive for selectively affecting the resilience of the fabric.

16. The headwear stiffening fabric of claim 8, wherein the warp yarn has a cross-section diameter of less than 15/1 and is woven at more than 58 ends per inch.

17. The headwear stiffening fabric of claim 16, wherein the warp yarn has a cross-section diameter of 30/1 or less and the fabric is woven to at least 72 ends per inch.

18. The headwear stiffening fabric of claim 8 wherein the filler yarn comprises a monofilament yarn.

19. The fabric of claim 8 further comprising a thermosetting adhesive.

* * * * *